US007490416B2

(12) United States Patent
Townsend

(10) Patent No.: US 7,490,416 B2
(45) Date of Patent: Feb. 17, 2009

(54) SHOE WITH CUSHIONING AND SPEED ENHANCEMENT MIDSOLE COMPONENTS AND METHOD FOR CONSTRUCTION THEREOF

(76) Inventor: Herbert E. Townsend, 3155 Balsam Rd., Center Valley, PA (US) 18034

( * ) Notice: Subject to any disclaimer, the term of this patent is extended or adjusted under 35 U.S.C. 154(b) by 331 days.

(21) Appl. No.: 10/996,235

(22) Filed: Nov. 23, 2004

(65) Prior Publication Data

US 2005/0160626 A1 Jul. 28, 2005

Related U.S. Application Data

(60) Provisional application No. 60/539,288, filed on Jan. 26, 2004, provisional application No. 60/548,077, filed on Feb. 26, 2004.

(51) Int. Cl.
*A43B 13/18* (2006.01)

(52) U.S. Cl. ..... 36/28; 36/30 R; 36/154

(58) Field of Classification Search ..... 36/28, 36/30 R, 153, 154, 29, 35 R
See application file for complete search history.

(56) References Cited

U.S. PATENT DOCUMENTS

| | | | | |
|---|---|---|---|---|
| 2,546,827 | A * | 3/1951 | Lavinthal | 36/154 |
| 3,257,742 | A * | 6/1966 | Feinberg | 36/44 |
| 3,649,426 | A | 3/1972 | Gates | |
| 4,316,332 | A | 2/1982 | Giese et al. | |
| 4,471,538 | A | 9/1984 | Pomeranz et al. | |
| 4,768,295 | A * | 9/1988 | Ito | 36/28 |
| 4,808,469 | A * | 2/1989 | Hiles | 428/318.6 |
| 5,544,432 | A | 8/1996 | Kita | |
| 5,554,694 | A | 9/1996 | Crow | |
| 5,604,998 | A | 2/1997 | Kita | |
| 5,787,609 | A * | 8/1998 | Wu | 36/28 |
| 6,050,001 | A * | 4/2000 | Ditrtrich | 36/35 R |
| 6,120,880 | A | 9/2000 | Crow | |
| 6,270,872 | B1 | 8/2001 | Cline et al. | |
| 6,481,120 | B1 * | 11/2002 | Xia et al. | 36/44 |
| 6,568,102 | B1 | 5/2003 | Healy et al. | |
| 6,589,630 | B1 | 7/2003 | Crow | |
| 6,701,529 | B1 | 3/2004 | Rhoades et al. | |
| 6,770,578 | B2 | 8/2004 | Veiga | |
| 7,107,704 | B2 * | 9/2006 | Dennis et al. | 36/44 |
| 7,284,342 | B2 * | 10/2007 | Avent et al. | 36/44 |
| 2003/0061733 | A1 * | 4/2003 | Karsten | 36/43 |

* cited by examiner

*Primary Examiner*—Ted Kavanaugh
(74) *Attorney, Agent, or Firm*—Jay L. Lazar

(57) ABSTRACT

An athletic shoe, in particular a running shoe, having improved cushioning and energy returning properties that vary depending upon the speed of the runner due to incorporation of at least one insert containing dilatant compound encapsulated in a shell and set into the midsole of the running shoe is disclosed. A method for converting the midsole of an existing running shoe is also disclosed.

11 Claims, 5 Drawing Sheets

FIG. 4
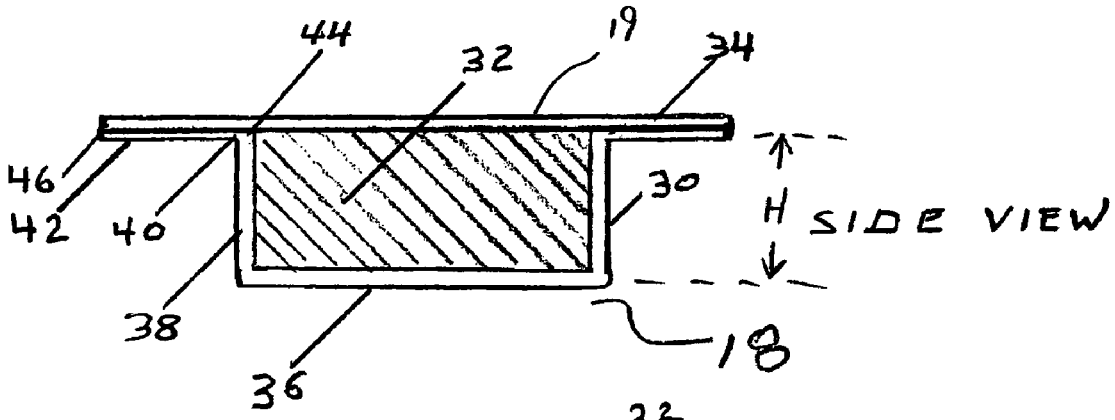
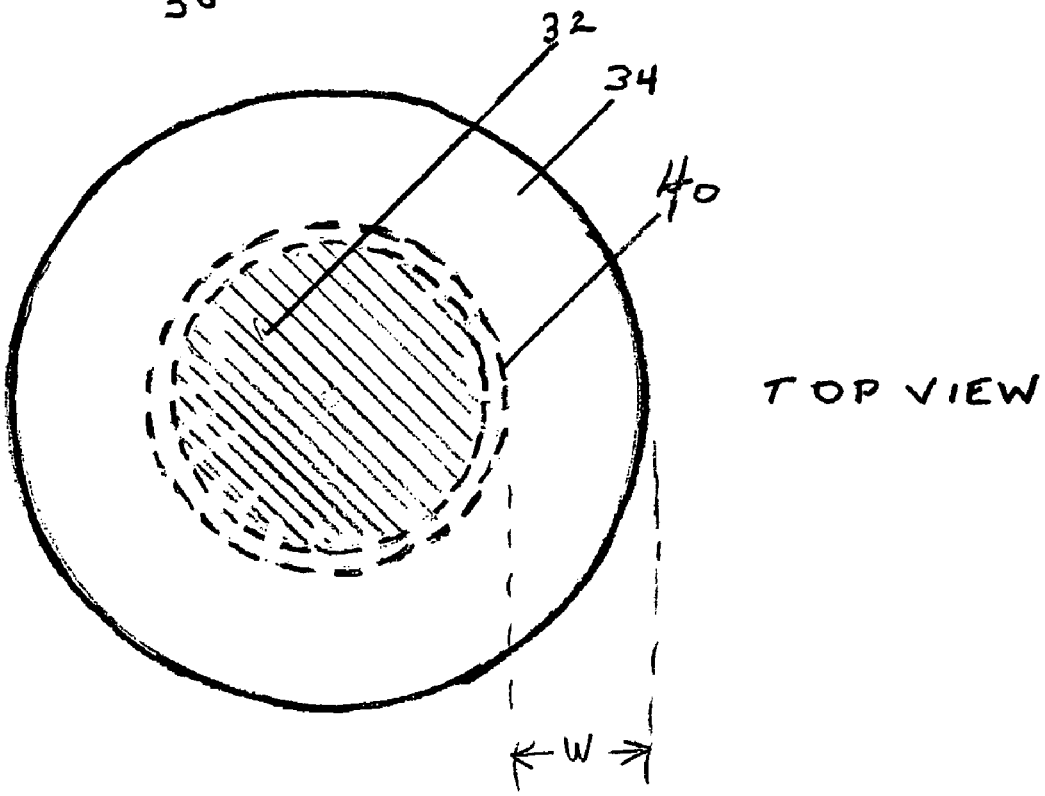
Fig. 5

SHOE WITH CUSHIONING AND SPEED ENHANCEMENT MIDSOLE COMPONENTS AND METHOD FOR CONSTRUCTION THEREOF

CROSS-REFERENCE TO RELATED APPLICATIONS AND CLAIM TO PRIORITY

This application claims the benefit under 35 U.S.C. § 120 of Provisional Applications 60/539,288 and 60/548,077, filed Jan. 26, 2004 and Feb. 26, 2004, respectively, and hereby incorporates both said Provisional Applications by reference.

FIELD OF THE INVENTION

The disclosed invention is directed to an athletic shoe, in particular a running shoe, having improved cushioning and energy returning properties that vary depending upon the speed of the runner due to incorporation of at least one insert containing dilatant compound encapsulated in a shell and set into the midsole of the running shoe.

BACKGROUND OF THE INVENTION

Shoes are generally intended to provide comfort and protection to the foot by fulfilling a number of functions related to the interface between the bottom of the foot and the surface on which the foot impacts during walking and running. Among these functions are: protection against cuts and abrasion; traction to prevent slipping; shock absorption to avoid injuries and bone and muscle damage that can be caused by repeated pounding of the foot against the walking or running surface; flexibility to allow natural body movements; cushioning for comfort; and the ability to behave elastically so that energy is conserved in walking and running.

Running shoes are shoes specifically made for running. Some running shoes are made for athletic competitions based on speed and endurance. Other running shoes are made for training for said competitions, as well as for non-competitive-related running for purposes such as exercise and fun. It is desirable during periods of actual competition to maximize the elastic behavior of a running shoe each time the runner's foot hits the ground, so as to conserve energy and provide a spring-like energy-returning effect with each step the runner makes and thereby assist the runner in achieving and sustaining higher speed, while nevertheless giving a level of cushioning and energy absorption suitable for comfort and injury and damage prevention. However, when running shoes are worn during periods when higher speed is less important, such as non-competitive running, walking, and jogging, it is desirable to maximize cushioning for comfort and shock absorption to prevent injury and damage. Moreover, it is desirable that all components of a running shoe be durable and lightweight.

Elasticity affects speed in two important ways. First, when the shoe behaves elastically, more energy is returned, and running becomes more efficient. It is known from physics that the fundamental, or resonant, frequency (F) of simple harmonic oscillator (a mass connected to a spring) is given by the expression, $$F = A \text{ times square root } (K/M)$$

where A is a constant, K is elasticity of the spring, and M is the mass of the body. The amplitude of oscillation and energy efficiency is greatest at resonant frequency, and the above equation shows that the resonant frequency increases with increasing elasticity, and with decreasing weight. A runner's resonant frequency also increases in a similar way, so that as the shoes become more elastic, at a given weight the runner becomes more efficient at a faster pace.

According to Hooke's Law, elastic materials can be described in terms of a property known as the elastic modulus, that is, a linear relationship between applied force and the amount the materials deform. For a given level of applied force, low-modulus materials deform more than high-modulus materials. Running shoes that interpose low-modulus materials between the bottom of the foot and the walking and running surface are better for absorbing energy to provide cushioning and shock absorption. Running shoes that interpose high-modulus materials are better for storing elastic energy and returning it to the runner's foot as it lifts off the ground. Running shoes can be optimized for either cushioning and shock absorption on the one hand or speed on the other hand by control of the elastic modulus.

Accordingly, a great variety of running shoes and related devices is available on the market and described in prior art. Many running shoe components and materials are known which provide cushioning that attenuates and dissipates ground reaction forces. Prior art shoes have long incorporated a midsole composed of closed cell viscoelastic foams, such as ethyl vinyl acetate ("EVA") and polyurethane ("PU"). EVA and PU are lightweight and stable foam materials that possess viscous and elastic qualities. The density or durometer, i.e., hardness, of EVA and PU can be altered by adjusting the manufacturing technique to provide differing degrees of cushioning. Alternate shoe structures for cushioning the impact of heel strike by incorporating gas or liquid or cushioning devices combinations thereof in chambers in the midsole are also well known. However, said running shoes and related devices are generally constructed of materials and in such a manner as to interpose materials having fixed elastic moduli between a runner's foot and the walking and running surface in order to achieve specific cushioning, shock absorbing and energy storing and returning properties.

Dilatant compounds are also well known. For purposes of this invention, a dilatant compound is a polymeric material that changes from soft and pliable under slow application of a load to elastic and bouncy under rapid application of a load. Technically, this means that a dilatant compound is a polymeric material whose yield point and elastic modulus increase with increasing strain rate. In other words, it is a liquid with inverse thixotropy, that is, a viscous liquid suspension that temporarily solidifies under applied pressure. Alternatively, it can be described as a liquid suspension in which the resistance to flow increases faster than the rate of flow.

A well-known example of a dilatant compound is the toy, Silly Putty® as described in U.S. Pat. No. 2,541,851. (Silly Putty is a registered trademark of Binney and Smith). Silly Putty® flows when slowly squeezed in the hand, but bounces when dropped on the floor. This behavior is known as strain-rate sensitivity. As shown in FIG. 7, the material is soft and pliable under slow application of load, or slow strain rate. At faster application of load, or high strain rate, the material behaves elastically, as indicated by the steeper slope of the left-hand side of the fast-load response shown schematically on FIG. 7.

Moreover, as shown in FIG. 7, the yield point, i.e., the load at which the response changes from sloped (elastic) to horizontal (plastic) also increases at faster application of load. Since the amount of elastic energy stored is equal to the area beneath the elastic portion of the curve, it is evident that much more energy is stored during fast loading.

While it has been taught to interpose devices having variable elastic moduli between a runner's foot and the midsoles of running shoes so as to provide variable shock absorbing and cushioning properties, it has not been taught to provide midsoles that achieve higher energy storing and returning properties at higher running speeds.

SUMMARY OF THE INVENTION

Generally, the present invention describes an improved running shoe having a midsole with a modulus of elasticity and yield point that increase at higher running speeds.

In addition, the present invention describes a device that can be incorporated into the midsoles of existing running shoes to achieve higher energy storing and returning properties at higher running speeds.

Further, the present invention describes a method for incorporating said devices into the midsoles of existing running shoes so as to achieve higher energy storing and returning properties at higher running speeds.

BRIEF DESCRIPTION OF THE DRAWINGS

FIG. 4 is a fragmentary longitudinal cross section of a shoe midsole insert of the present invention.

FIG. 5 is a top view of a shoe midsole insert of the present invention.

DETAILED DESCRIPTION OF THE PREFERRED EMBODIMENTS

Figure 1:
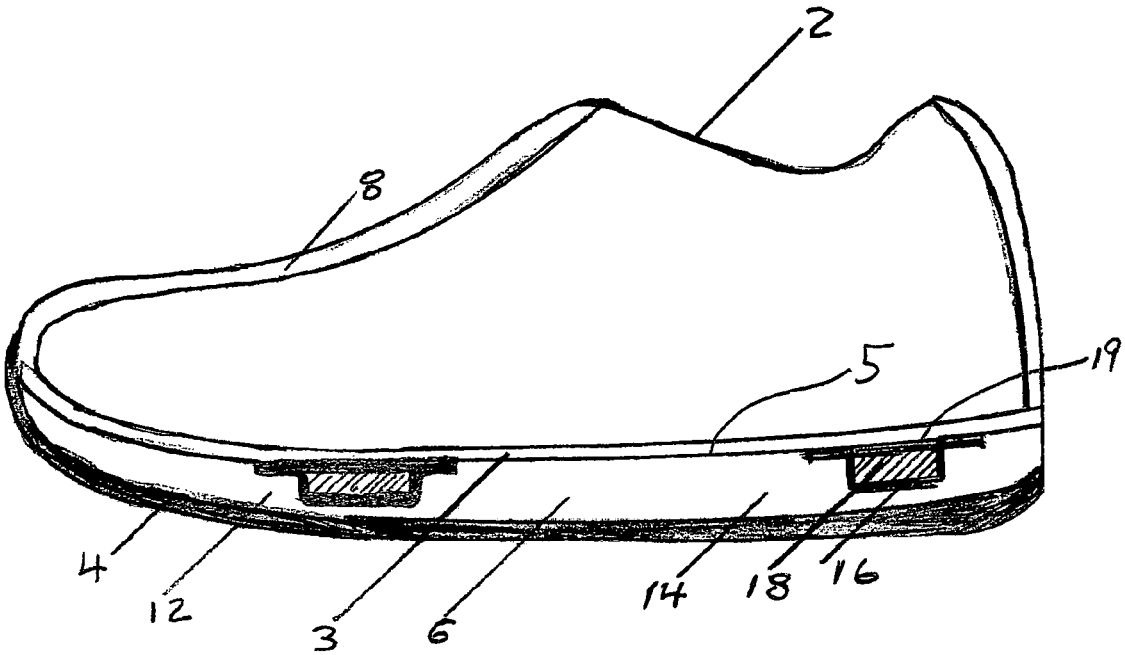
FIG. 1 is a longitudinal cross section of a shoe of the present invention.

Referring now to the drawings, and first more particularly to FIG. 1, a running shoe of the present invention is indicated in its entirety by the reference numeral 2. The shoe includes an outsole, generally indicated at 4, and a midsole, generally indicated at 6. Preferably, the outsole 4 is made of conventional durable material, such as carbon rubber, and the midsole 6 is made of a conventional cushioning material, such as foam PU or foam EVA. Other components of the running shoe include an upper 8, which may be of leather or other conventional upper materials. The midsole has an upper surface 5. An insole 3, sometimes called a sock liner and constructed from conventional thin, flexible material such as fabric conventionally bonded to foam PU or EVA, preferably is interposed between the bottom of the runner's foot and the midsole upper surface 5 for enhanced comfort. Alternatively, the insole may be omitted without impairing the function of the present invention.

The midsole 6 receives compressive force either directly from the runner's foot or via the insole 3 when the runner is standing, walking or running.

Figure 2:
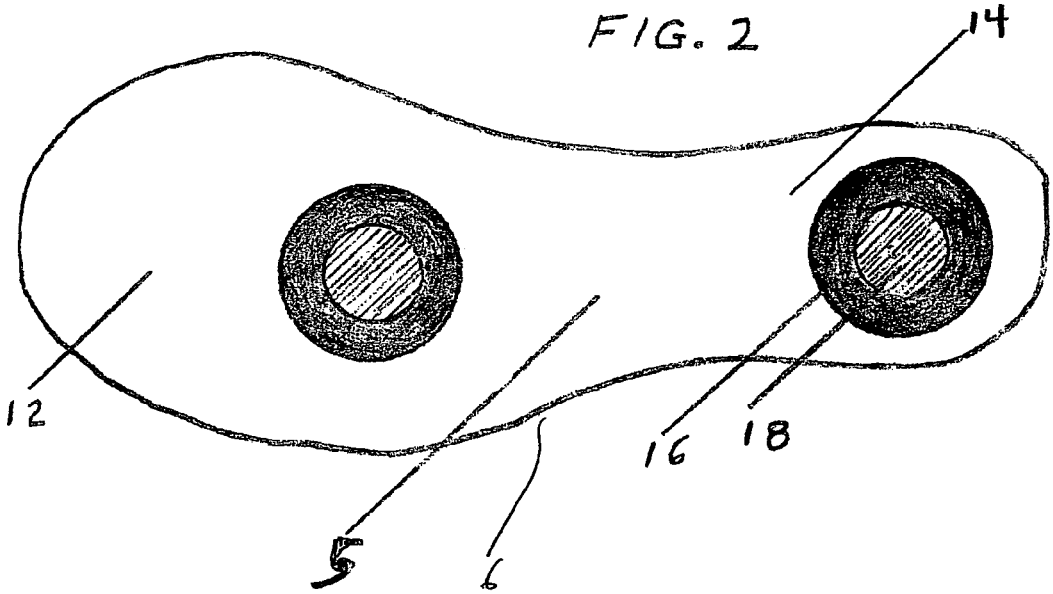
FIG. 2 is a top view of a shoe midsole of the present invention.

Referring to FIG. 2, the midsole 6 includes a forefoot region, generally indicated at 12 and a heel region, generally indicated at 14. The midsole 6 includes at least one cavity 16, preferably in the heel region 14. Alternatively, the cavity is included in forefoot region 12. Alternatively, one cavity is included in the heel region 14 in combination with one cavity that is included in the forefoot region 12.

Figure 3:
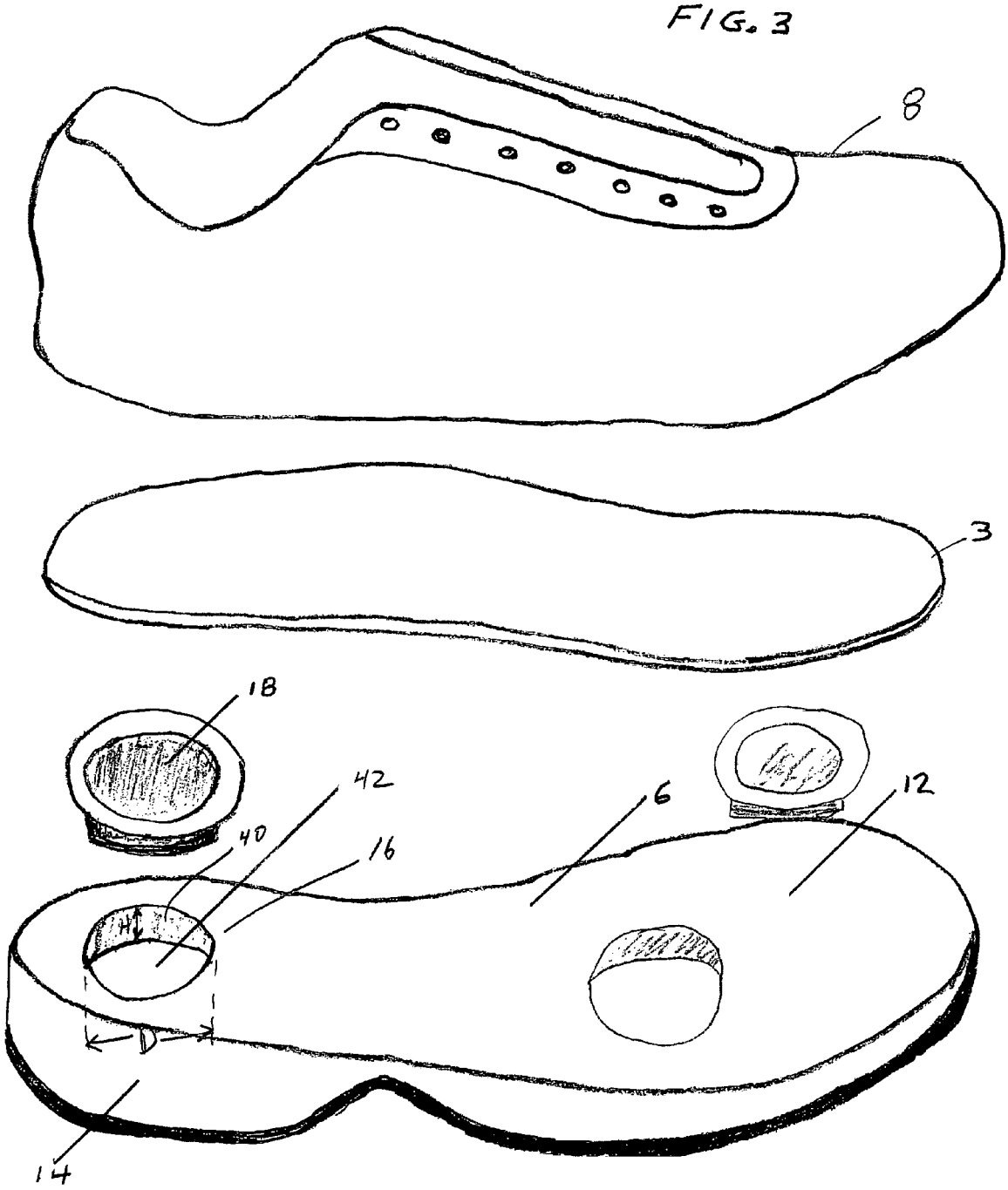
FIG. 3 is an assembly drawing of a shoe of the present invention.

Referring to FIG. 3, each cavity 16 has a continuous side wall 40 and a bottom wall 42. Preferably each cavity 16 is sized and shaped for receiving an insert 18 filled with a dilatant compound, said insert 18 having been constructed to be substantially the same size and shape as the cavity 16.

Referring to FIG. 4, preferably insert 18 is generally cylindrical or disc-shaped and has an upper surface 19 that conforms to the contour of midsole upper surface 5 in order to provide a uniform support on which the user may place his or her heel without feeling any discontinuities. The cavity 16 preferably is cylindrical in order to receive and retain insert 18. Insert 18 may be secured within cavity 16 with a suitable adhesive.

In the preferred embodiment, the dilatant compound is derived from a mixture of dimethyl siloxane, hydroxy-terminated polymers with boric acid, Thixotrol ST® brand organic rheological additive manufactured by Elementis Specialties, Inc., polydimethysiloxane, decamethyl cyclopentasiloxane, glycerine, and titanium dioxide. This compound is sold by Dow Corning as Dilatant Compound No. 3179. Other dilatant compounds that could be used are available on the market and described in the prior art.

Referring to FIG. 4, the dilatant compound is preferably encapsulated fully, without air pockets or pockets of any other materials, in a shell that, when filled completely with the dilatant compound, will fit snugly into the cavity in the midsole. The shell comprises a bottom receptacle portion 30 into which the dilatant compound 32 is received and a top cover portion 34 that is attached to the bottom receptacle portion to seal in the dilatant compound. The bottom receptacle portion is a single piece having a bottom wall 36, a continuous sidewall 38 molded upward a height H from the bottom wall to a top edge 40, and a flange 42 molded outward from its inner perimeter 44 on the top edge to an outer perimeter 46. The top cover portion 34 is a flat piece shaped substantially congruent to the outer perimeter of the flange 42. The shell should be fabricated from material that is thin enough and flexible enough so as to permit immediate conformance of the dilatant compound-filled shell to the runner's foot and so that at any time the elastic modulus of the shell and the dilatant compound together will be insignificantly different from the elastic modulus of the dilatant compound alone. The shell should also be strong and durable enough so as not rupture upon the repeated application of pressures of up to 250 pounds per square inch. Preferably, the shell is made of polyurethane 0.007 inches thick. Preferably, for ease of manufacture, the shape of the bottom wall of the bottom receptacle portion is circular, the continuous sidewall is cylindrical having diameter D, and the outer perimeters of the flange and of the top cover piece are circular. Preferably, the width W of the flange is in a range between ⅛" and ½". Preferably, after the dilatant compound has been received into the bottom receptacle portion, the top cover piece is attached to the flange using radio frequency welding, which can be commercially accomplished by Polyworks LLC of North Smithfield, R.I. Upon manufacture as described above, the shell filled with dilatant compound together comprise the insert 18. Other shapes of inserts may be conventionally constructed. It should be recognized that since the shell material is thin and flexible and the dilatant compound behaves as a viscous liquid in the absence of an applied force, the shape of the insert may vary from the as-constructed shape.

Preferably, the cavity 16 may be conventionally molded into the midsole during manufacture of the midsole. The cavity may also be carved into the midsole by conventional means. Preferred cylindrical cavities may be carved using a drill fitted with a commercially-available Forstner drill bit, the size of which drill bit is chosen to create a cylindrical cavity having, with reference to FIG. 3, a diameter equal to the diameter D of the insert to be placed therein, and a depth equal to the height H of the continuous sidewall 36 of the bottom receptacle piece of the insert.

The insert is set into the cavity so that the bottom wall 36 and side wall 38 of the insert are in maximum contact with the bottom wall 42 and side wall 40 of the cavity. In setting the insert into the cavity, any gaps either between the side wall of the cavity and the side wall of the insert or the bottom wall of the insert and the bottom wall of the cavity or both are preferably filled with commercially-available elastomeric filler material such as Silicone II® brand 100% silicone sealant manufactured and sold by General Electric Company. Preferably, the insert is permanently retained in the midsole cavity using conventional adhesives to attach the bottom and side wall of the insert to the bottom and side wall of the cavity. The insert may also be permanently retained in the cavity by attaching the insole to the midsole upper surface 5 using conventional adhesives. The insert may also be removably set into the cavity and temporarily retained in the cavity by the pressure of the runner's foot in contact with the insole 3 or directly in contact with the midsole upper surface 5 and the top cover portion 34 of the insert.

Preferably, when pressure is initially applied from the runner's foot to the insert when the runner first stands in a shoe, the dilatant compound will be compressed against the bottom and side walls of the insert, thereby exerting pressure against the bottom and sides of the midsole cavity. Preferably, the midsole is constructed from a material with an elastic modulus lower than the elastic modulus of the dilatant compound after the dilatant compound has been subjected to the impact of fast running. Therefore, under slow application of force from the foot, as in walking or slow running, the dilatant compound deforms plastically (i.e., flows like a liquid) and transfers the foot's applied force to the surrounding midsole so that the dilatant and midsole together exhibit the low elastic modulus of the midsole material, thereby promoting cushioning and shock absorption. Under fast application of force, as in when the foot begins to impact against the insert during fast running, the dilatant compound will exhibit its inverse thixotropic properties and achieve a higher modulus of elasticity than the surrounding midsole; then, the insert will transfer less of the foot's impact force to the surrounding midsole, and instead will return more of the energy directly to the foot, thereby assisting in lift-off and increasing the runner's speed and energy efficiency.

On the one hand, it has been found that if the inner perimeter of the top edge 40 of the insert shell is larger than the perimeter of the portion of the runner's heel that exerts a degree of compressive impact on the insert necessary to cause the dilatant compound to exhibit its inverse thixotropic properties during running, portions of the dilatant compound will initially become relocated by "oozing" to portions of the insert outside said perimeter, so that exhibition of the inverse thixotropic properties does not occur or is significantly diminished, rather than remaining within the perimeter at the bottom of the runner's heel and receiving compressive impacts from the heel during running. In that case, the exhibition of the dilatant compound's inverse thixotropic properties in the packet during running will be diminished and the full benefits of the present invention will not be realized. On the other hand, if the inner perimeter of the top edge of the insert shell is smaller than the perimeter of the portion of the runner's heel that exerts a degree of compressive impact on the top wall of the insert necessary to cause the dilatant compound to exhibit its inverse thixotropic properties during running, the portions of the runner's heel that are outside said inner perimeter will exert compressive impact on the elastomeric, non-dilatant portions of the midsole. In that case, the full benefits of the present invention will not be realized. Preferably, the diameter D of each midsole insert would be custom fitted and fabricated based on the size and shape of the foot of the runner. Also preferably, the height H of the midsole insert would be custom fitted based on the thickness of the midsole. However, recognizing that such custom fitting and fabricating entails additional expense, I have found that a cylindrical insert in the heel region 14 having a diameter D of one and one half inches (1½") and a height H of one-half inches (½") provides substantially all of the benefits of the present invention in men's shoe sizes 5 through 13, which is equivalent to women's shoe sizes 6 through 14. Diameters varying from the preferred diameter by up to ⅛" and heights varying from the preferred height by up to ⅛" also provide substantially all of the benefits of the present invention.

The insert constructed of the size and shape described above and constructed of the materials described above incorporated into the midsole of the running shoe maximize shock absorption and comfort during walking, jogging, and slow running, while maximizing the elastic return of energy during fast running.

Figure 6:
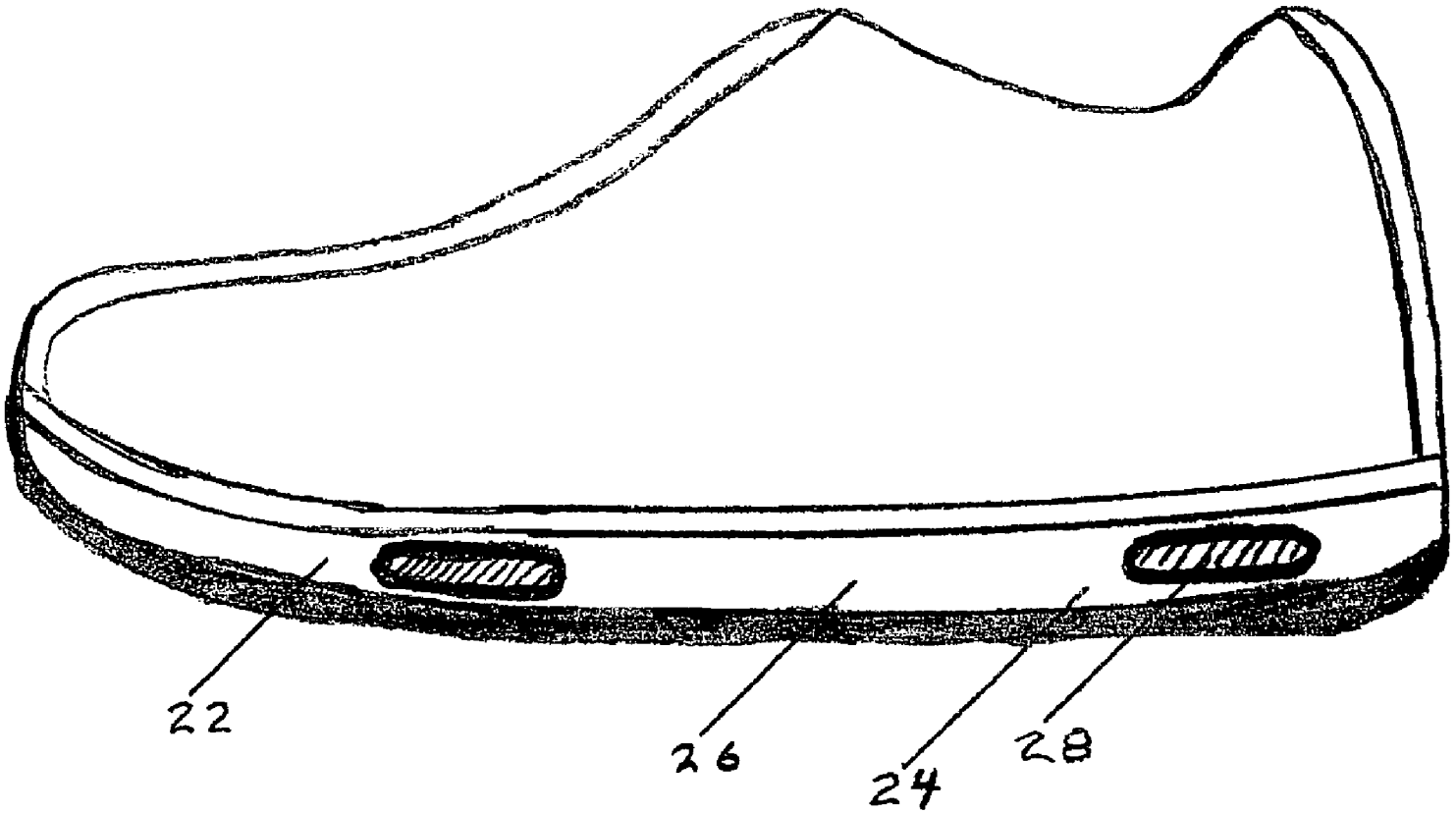
FIG. 6 is a longitudinal cross section of a shoe of the present invention.
Figure 7:
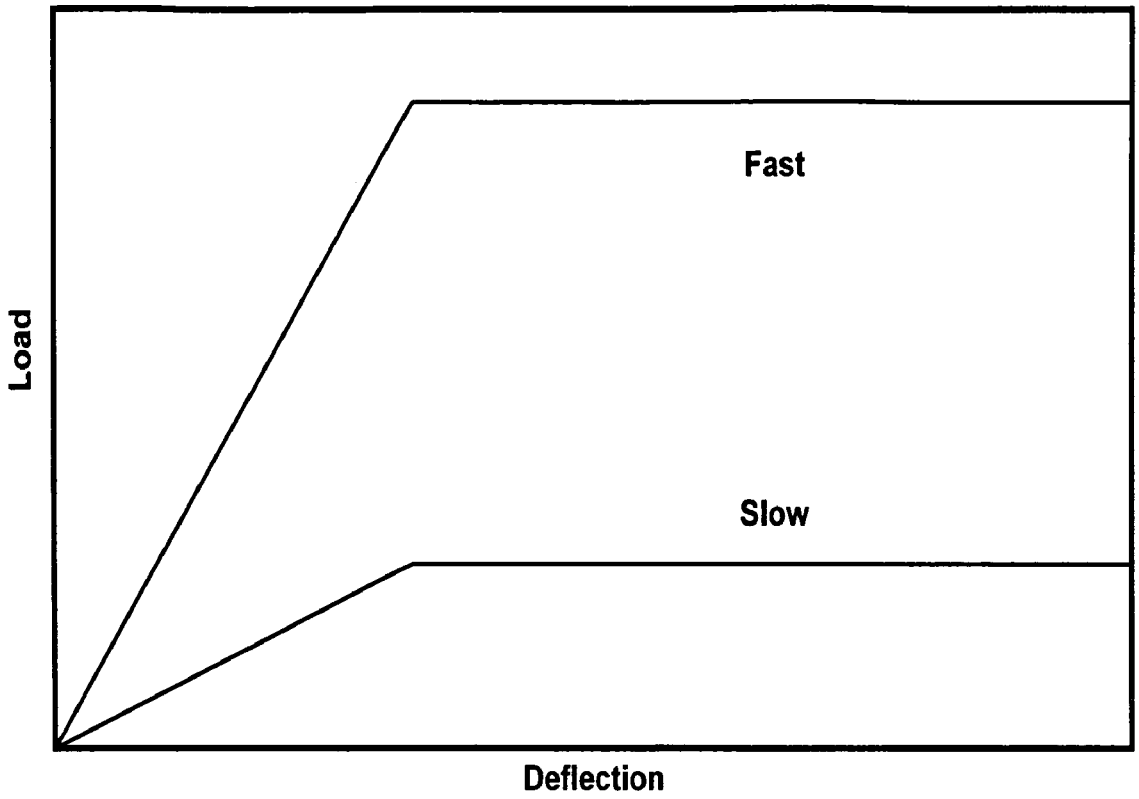
FIG. 7 is a chart showing how the elasticity of the material comprising the midsole insert of the present invention varies with the rate of application of the load on the material.

In an alternate embodiment of the invention, the dilatant compound is completely enclosed in one or more midsole chambers during manufacture of the midsole, using methods and materials of enclosure taught in the prior art. Referring to FIG. 6, the midsole 26 includes at least one chamber 28, preferably in the heel region 24, or in the forefoot region 22, or at least one chamber in each of the heel region and the forefoot region.

Many long distance runners are identified as heel strikers, meaning that they tend to land on the heel of the shoe. For this reason it is important that a midsole insert always be present beneath the heel. Other runners, particularly sprinters and short distance runners, tend to land on the forefoot. For these runners, a forefoot midsole insert of the present invention may be set in the forefoot region of the midsole. Similarly, using the methods described above, an insert of the present invention may be placed in the heel region of the midsole in combination with an insert of the present invention placed beneath the forefoot. The following examples illustrate the use of the present invention:

EXAMPLE 1

The rear midsole regions in a pair of worn out running shoes were cut open to expose gel pads beneath the heel. The gel pads were removed and replaced by midsole inserts consisting of packets of a dilatant compound, namely Silly Putty, wrapped in plastic. It was noted that the dilatant-compound midsole inserts restored the cushioning to the worn shoes to a level equal to or exceeding that of new shoes. The shoes were then used by a runner who trained at various speeds in a wide range of climatic conditions, and on a variety running surfaces for 100 miles. This trial demonstrated that a dilatant-compound midsole insert provides the combination of cushioning, shock absorption, and durability required for a running shoe.

EXAMPLE 2

The performance of shoes with dilatant-compound midsole inserts as described in Example 1 was compared to that of the identical shoes with the original gel pads replaced, and to that of a new pair of shoes with intact gel pads.

For purposes of this comparison, a 0.1-mile course was marked along a straight stretch of flat asphalt road. A runner was timed as he attempted to run as fast as possible while alternately wearing one of the three types of shoe. Between each sprint, the runner jogged back to the starting line and changed shoes for the next sprint. The three-way comparison was repeated a total of five times. As shown in Table 1, the average time for the shoe with the dilatant compound inserts (DC) was 1.29 seconds faster than the same shoe with its original gel pad replaced (Gel), and 1.83 seconds faster than the new shoe (NEW). These differences suggest improvements in mile times of 13 and 18 seconds, respectively. Statistical analyses (T-test) indicate that the probability that such differences could occur by chance is 2% or less.

TABLE 1

| Trial No. | Time, sec DC | Time, sec Gel | Time, sec New | Difference, sec Gel-DC | Difference, sec New-DC |
|---|---|---|---|---|---|
| 1 | 39.43 | 41.00 | 42.28 | 1.57 | 2.85 |
| 2 | 37.29 | 39.59 | 38.26 | 2.30 | 0.97 |
| 3 | 37.03 | 38.16 | 39.11 | 1.13 | 2.08 |
| 4 | 35.74 | 36.99 | 38.18 | 1.25 | 2.44 |
| 5 | 36.41 | 36.59 | 37.22 | 0.18 | 0.81 |
| Total | 185.90 | 192.33 | 195.05 | 6.43 | 9.15 |
| Average | 37.18 | 38.47 | 39.01 | 1.29 | 1.83 |
| Std Dev | 1.39 | 1.84 | 1.95 | 0.77 | 0.90 |

EXAMPLE 3

Six hundred pairs of various size running shoes with conventional foam EVA midsoles were factory produced using conventional manufacturing methods. Two pairs of size 11 shoes were selected at random, and carefully inspected for quality. A 0.5-inch-deep, 1.5-inch-diameter cavity was bored into the midsole beneath the heel regions of each shoe of one pair (Pair A). An insert constructed of dilatant compound encapsulated in a radio-welded 0.007 inch wall thickness polyurethane shell with the same dimensions as the cavity was set into the cavity of each shoe of Pair A using the methods described above. The second pair (Pair B) was left unchanged.

To compare the high-speed performance of Pairs A and B, a 0.1-mile course was marked along a downhill stretch of asphalt road. A runner was timed as he attempted to run the downhill segment as fast as possible while alternating shoes A and B. Between each sprint, the runner jogged back to the start, and changed shoes for the next sprint. This two-way comparison was repeated a total of eight times.

As shown in Table 2, the average time for the A shoes with the dilatant compound inserts of the present invention was 1.72 seconds faster than the B shoes without the dilatant compound insert. This result clearly demonstrates the speed-enhancing property of the dilatant compound midsole insert of the present invention. The magnitude of the difference suggests improvements in mile times of 18.9 seconds. Statistical analysis (T-test) indicates that this difference is real at a level of confidence greater than 99%.

TABLE 2

| Trial No. | Time, sec A | Time, sec B | Difference, sec A − B |
|---|---|---|---|
| 1 | 34.52 | 35.01 | 0.49 |
| 2 | 34.29 | 36.34 | 2.05 |
| 3 | 31.97 | 35.66 | 3.69 |
| 4 | 33.47 | 34.12 | 0.65 |
| 5 | 31.11 | 34.17 | 3.06 |
| 6 | 32.34 | 33.28 | 0.94 |
| 7 | 31.00 | 33.49 | 2.49 |
| 8 | 30.12 | 31.84 | 1.72 |
| Total | 258.82 | 273.91 | 15.09 |
| Average | 32.35 | 34.24 | 1.89 |
| Std Dev | 1.61 | 1.43 | 1.16 |

The present invention has been described in terms of a preferred embodiment, it being understood that obvious modifications and additions to this preferred embodiment will become apparent to those skilled in the relevant art upon a review of this disclosure. It is intended that all such obvious modifications and additions be covered by the present invention to the extent that they are included with the scope of the several claims appended hereto.

What is claimed is:

1. A shoe to be worn on a foot, said shoe comprising a midsole having a top surface, said shoe midsole fabricated from material having a fixed elastic modulus and having at least one cavity formed in said top surface below the bottom of the foot, said at least one cavity filled with material consisting essentially of a dilatant compound, all of which material consisting essentially of a dilatant compound is retained below the bottom of the foot.

2. The shoe in claim 1 wherein said material consisting essentially of a dilatant compound is contained within in a shell having the same size and shape as the at least one cavity and said shell is set into the at least one cavity.

3. The shoe in claim 1 wherein said material consisting essentially of a dilatant compound is contained in a shell set into the at least one cavity, and said at least one cavity comprises a bottom portion and a side wall molded upward from said bottom portion to said top surface, and said shell comprises a bottom portion having the same size and shape as the bottom portion of the at least one cavity, a side wall having the same size and shape as the side wall of the at least one cavity, and a top portion sealed to said shell side wall so as to encapsulate said material consisting essentially of a dilatant compound.

4. The shoe in claim 1 wherein said material consisting essentially of a dilatant compound is encapsulated within a shell set into the at least one cavity, and said at least one cavity comprises a bottom portion and a side wall molded upward from said bottom portion to said top surface, and said shell comprises a bottom portion having the same size and shape as the bottom portion of the at least one cavity, a side wall having the same size and shape as the side wall of the at least one cavity, and a top portion sealed to said shell side wall so as to encapsulate said material consisting essentially of a dilatant compound, and said shell is fabricated from material having a modulus of elasticity such that the modulus of elasticity of the shell combined with the material consisting essentially of the dilatant compound that is encapsulated within the shell is insignificantly different from the modulus of elasticity of only the material consisting essentially of the dilatant compound.

5. The shoe of claim 1 wherein said material consisting essentially of a dilatant compound is derived from a mixture of dimethyl siloxane, hydroxy-terminated polymers with boric acid, Thixotrol ST®, polydimethysiloxane, decamethyl cyclopentasiloxane, glycerine, and titanium dioxide.

6. The shoe of claim 1 wherein said at least one cavity is cylindrically shaped and has a diameter between 1⅜" and 1⅝" and has a side wall height between ⅜" and ⅝".

7. A shoe to be worn on a foot, said shoe comprising (a) a midsole made of elastomeric material, (b) a cavity beneath the heel portion of said midsole, (c) a disc-shaped insert filling the cavity, said insert comprising a thin, flexible wall with negligible elasticity when compared with said elastomeric material and when compared with said material consisting essentially of a dilatant compound, said thin, flexible wall enclosing a material consisting essentially of a dilatant compound with less elasticity than the elastomeric midsole material under slow load and greater elasticity than the elastomeric midsole material under fast load, all of which dilatant compound is retained below the foot.

8. The shoe of claim 7, wherein said disc-shaped insert when the shoe is off the foot has a diameter between 1⅜" and 1⅝" and has a thickness between ⅜" and ⅝".

9. The shoe of claim 7, wherein said material consisting essentially of a dilatant compound is derived from a mixture of dimethyl siloxane, hydroxy-terminated polymers with boric acid, Thixotrol ST®, polydimethysiloxane, decamethyl cyclopentasiloxane, glycerine, and titanium dioxide.

10. A shoe to be worn on a foot, said shoe comprising (a) a midsole made of elastomeric material, (b) a cavity beneath the heel portion of said midsole, (c) a disc-shaped insert filling the cavity, said insert comprising a thin, flexible wall with negligible elasticity, said wall enclosing a material consisting essentially of dilatant compound with less elasticity than the elastomeric midsole material under slow load and greater elasticity than the elastomeric midsole material under fast load, all of which material consisting essentially of a dilatant compound is retained below the foot, and wherein said disc-shaped insert when the shoe is off the foot has a diameter between 1⅜" and 1⅝" and has a thickness between ⅜" and ⅝", and wherein said material consisting essentially of a dilatant compound is derived from a mixture of dimethyl siloxane, hydroxy-terminated polymers with boric acid, Thixotrol ST®, polydimethysiloxane, decamethyl cyclopentasiloxane, glycerine, and titanium dioxide.

11. A shoe to be worn on a foot, said shoe comprising a midsole made of elastomeric material, said midsole containing a disc-shaped chamber encapsulating a material consisting essentially of dilatant compound with less elasticity than the elastomeric midsole material under slow load and greater elasticity than the elastomeric midsole material under fast load, all of which material consisting essentially of a dilatant compound is retained below the foot, and wherein said disc-shaped insert when the shoe is off the foot has a diameter between 1⅜" and 1⅝" and has a thickness between ⅜" and ⅝", and wherein said material consisting essentially of a dilatant compound is derived from a mixture of dimethyl siloxane, hydroxy-terminated polymers with boric acid, Thixotrol ST®, polydimethysiloxane, decamethyl cyclopentasiloxane, glycerine, and titanium dioxide.

* * * * *